United States Patent [19]

Johansson et al.

[11] 4,222,342

[45] Sep. 16, 1980

[54] APPARATUS FOR COATING A MOVING WEB

[75] Inventors: Gunnar Johansson; Mats O. Kullander, both of Säffle, Sweden

[73] Assignee: Billeruds Aktiebolag, Säffle, Sweden

[21] Appl. No.: 875,313

[22] Filed: Feb. 6, 1978

[30] Foreign Application Priority Data

Feb. 14, 1977 [SE] Sweden ..... 77015881

[51] Int. Cl.[3] ..... B05C 3/18; B05C 11/04

[52] U.S. Cl. ..... 118/50; 118/407; 118/410

[58] Field of Search ..... 118/50, 246, 123, 65, 118/411, 407, 413, 410

[56] References Cited

U.S. PATENT DOCUMENTS

| | | | |
|---|---|---|---|
| 2,344,232 | 3/1944 | Campbell et al. | 118/123 |
| 3,474,757 | 10/1969 | Dreher | 118/411 |
| 4,102,299 | 7/1978 | Wallsten | 118/50 |
| 4,125,641 | 11/1978 | Wallsten | 118/50 X |
| 4,136,635 | 1/1979 | Johansson et al. | 118/50 |

FOREIGN PATENT DOCUMENTS

| | | |
|---|---|---|
| 347306 | 7/1972 | Sweden . |
| 379292 | 11/1973 | Sweden . |

*Primary Examiner*—John P. McIntosh

*Attorney, Agent, or Firm*—Burns, Doane, Swecker & Mathis

[57] ABSTRACT

A coating composition is applied to a paper web while the web passes over an opening in a box in which a partial vacuum is maintained. The opening is divided into two sections by means of a support member disposed perpendicular to the direction of travel of the web. The coating composition is applied to the web in the downstream section of the opening, and the upstream section is considerably greater in area than the downstream section to create a tension on the web and thereby eliminate unstretched areas in the web.

15 Claims, 7 Drawing Figures

APPARATUS FOR COATING A MOVING WEB

The present invention relates to an apparatus for coating a moving strip or web, particularly a paper web, with a coating liquid or other fluid coating material, such as a coating slip. More particularly, the apparatus is of the type in which the coating composition is applied to the web while the web is passing an opening in a box in which a partial vacuum is maintained.

Coating a web while exposing it to a partial vacuum is previously known, for instance through Swedish patent specification No. 347,306. In the coating operation described here the web to be coated is drawn along in close contact with a first and a second long side edge of an elongate coating opening arranged in a low-pressure box and running substantially transversely in relation to the direction of travel of the web. The low-pressure box consists of a horizontal pipe and the long side edges of two horizontal support rods secured parallel to each other and substantially vertically one above the other on the pipe. One or two parallel rows of holes are arranged through the pipe wall between the support rods in order to connect the inside of the pipe wall between the support rods in order to connect the inside of the pipe with the space between the support rods. The pipe is connected to evacuating equipment to effect a partial vacuum in the pipe, and also to a supply of coating liquid which is drawn into the pipe due to the partial vacuum, and runs out through the lower row of holes while air is drawn in through the upper row of holes. The coating liquid, preferably of low viscosity and suitably consisting of water or a water solution, is said to be applied in excess on the web, and the excess is removed by one of the support rods. In order to support the side edges of the web while it is being drawn between the support rods, or to support the web along its entire width if, for instance, it is desired to increase the distance between the rods with unaltered low-pressure, perforated metal sheets with a concave surface facing the web may be arranged to bridge the gap between the support rods. It has been found that these support sheets result in a high friction, subjecting the web to considerable stress. Low-pressure coating as such, however, has proved to offer several important advantages. For instance the quantity of liquid applied can easily be regulated by adjusting the degree of partial vacuum, the depth to which the liquid penetrates into the web can be reduced and the content of solids in the liquid can be increased.

This promising technique has been further developed for coating with pigment coating slip. Swedish patent specification No. 73-15528-5 shows that it is known to perform low-pressure coating on a moving paper web using pigment coating slip by allowing the moving web to be carried by a solid surface, such as a rotating roller, in a position where the web is passed over the opening in the low-pressure box and by allowing the web to be in sealing contact with the box over two flexible blades therein, one for applying the coating slip and one for wiping it off. The pressure of the wiping-off blade against the web is regulated by means of the low pressure in the box. Under suitable conditions this gives extremely good coating results and great advantages. For instance, an increase in the solids content of the pigment coating slip results in a higher production of coated paper, the preparation of the coating slip and also the cleaning of the apparatus are simplified, and the surface of the coating will be smoother.

Under unfavourable conditions, however, certain difficulties may arise. For instance, large and hard particles from the web or the coating slip may be caught in front of the blade, or may lift a wide section of the blade when passing under it. Occasionally such particles may even tear the paper web. Furthermore, "slack areas" in the web may easily result in folds. Such "slack areas" may appear in a paper web having an uneven length, meaning that the edge portions of the web are longer than the central portion of the web.

Progress has also been made along another line of development. Swedish patent specification No. 75-04872-8 shows that it is known to modify the low-pressure box so as to permit roller coating under partial vacuum. The modified apparatus comprises, as above, a substantially tubular low-pressure box, but the row or rows of holes have been replaced by a slit, and the support rods have been omitted. The roller rotates in the slit and has a diameter substantially the same as the radius of the low-pressure box. The low-pressure box is kept partly filled with coating liquid, and the roller is partially immersed in the liquid so that the roller is not bent down. Before the coating liquid is applied by the roller on the moving web to be coated, the excess liquid is scrapped off the roller by a wiper so that a predetermined, accurately measured quantity of coating liquid is applied on the web. In comparison with blade coating, roller coating usually gives a less even surface but better coverage.

The primary object of the present invention is not only to maintain the advantages mentioned above, but also to improve the vacuum box so that its reliability in operation, and the coating quality, especially its covering ability, is increased.

According to the invention, the apparatus comprises a vacuum box with an elongate coating opening running substantially transversely in relation to the direction of travel of the web, and defined in said direction of travel by a first and a second long side edge, against which the web is intended to be in tight contact during its movement, members to effect a partial vacuum in the box, members for applying an excess of the coating liquid on the web through the coating opening, members for removing the excess from the web through the coating opening, and devices to support the web during its movement over the coating opening to prevent the web being drawn too strongly into the coating opening. The apparatus is characterised in that the support device comprises a support member which divides the coating opening into a first section located between the first long side edge and the support member, and a second section located between the support member and the other long side edge, said support member having a long, narrow outer section extending parallel with the long side edges and supporting the web during its movement across the coating opening, said outer section being considerably narrower in the direction of travel of the web than either of the two sections of the coating opening, and that the application members are arranged to apply the coating liquid on the web after the web has passed the first section of the coating opening so that the support member may consist of a separate element, the primary function of which is to support the web, or other element which as well as the supporting function, also has another primary function, for instance to apply the coating material on the web.

The specified combination of features enables the width of the coating opening in the direction of movement of the web to be made so great that a desired magnitude of the contact pressure of the web against the box can be achieved, even with moderately low pressure, without the friction of the web against the box being too great. As will be described, by altering the degree of partial vacuum it is possible to control several of the coating parameters. The suction into the coating opening to which the web is subjected when it passes the first section of the opening stretches the web before the application of the coating liquid, so that folds caused by "slack areas" in the web are avoided. When the web is passing over the opening of the low-pressure box, it is not supported by a rotating roller or similar solid surface. Therefore, the pressure difference between the inside of the box and the atmospheric pressure will also cause the soft, flexible web to mould itself around any particles between the web and the long side edges of the box opening. No particles will therefore be caught in front of a wiper or similar means for wiping off the excess coating liquid, where they would give rise to scratches or stripes in the coating layer. The particles pass through the nip formed between the web and the wiper without lifting the wiper from the web. The web coated with the apparatus according to the present invention is thus better covered and the coating effect achieved is similar to that achieved with what is known as air-brush coating.

In the following the invention will be further described with reference to the accompanying drawings.

Figure 1:
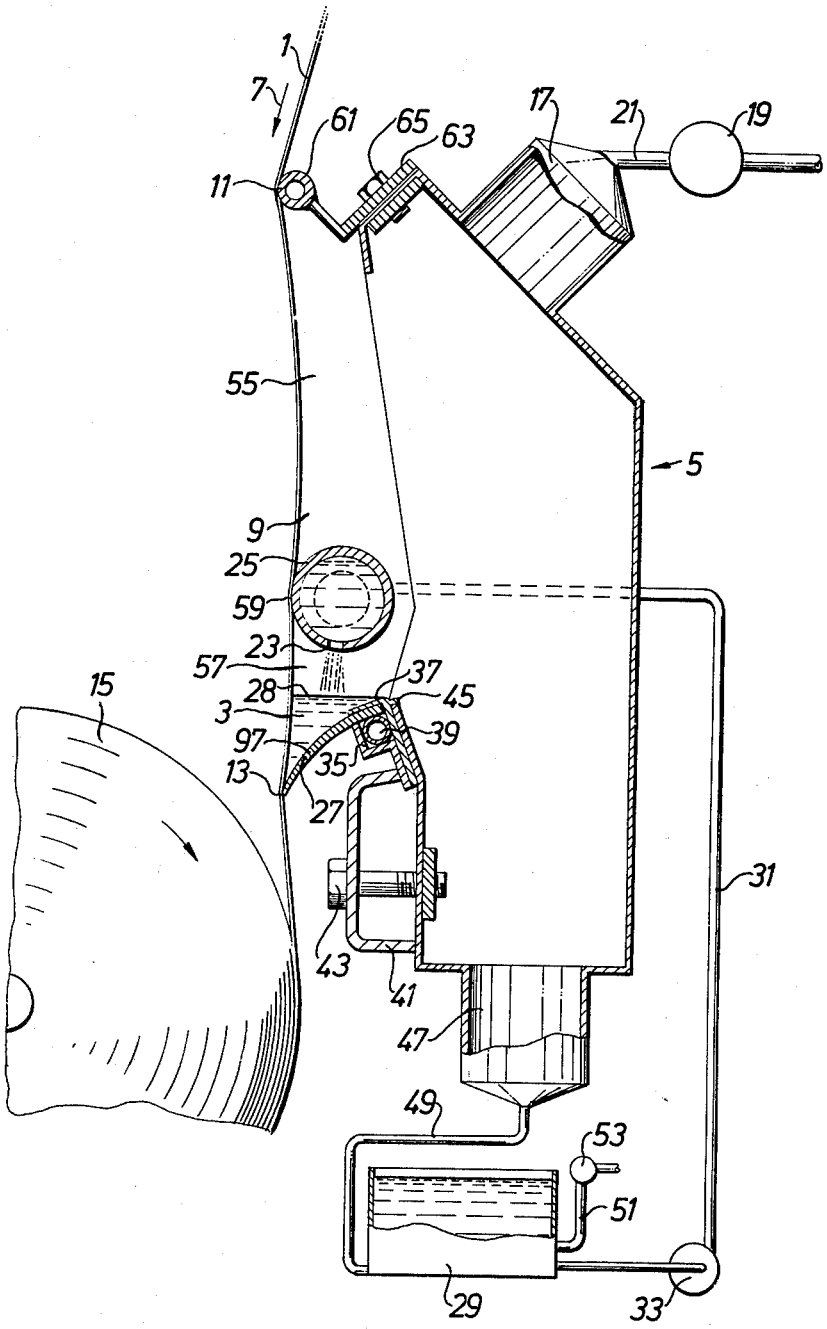
FIG. 1 shows a cross section through a vacuum box in a coating apparatus according to a preferred embodiment of the invention, and shows the apparatus while a moving web is being coated.
Figure 2:
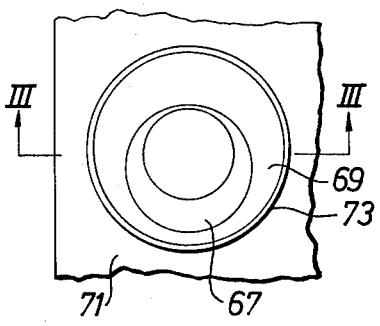
FIG. 2 is a part of an end view of the vacuum box shown in FIG. 1.
Figure 3:
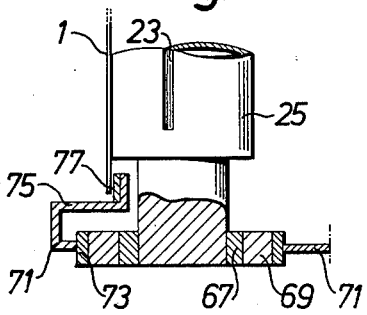
FIG. 3 is a section along the line III—III in FIG. 2.

The apparatus shown in FIGS. 1 to 3 is preferred for coating a moving web 1 with a coating liquid 3 or some other fluid coating material, for instance what is known as coating slip with relatively high solids content. The apparatus comprises a vacuum box 5 with an elongate coating opening 9 running substantially transversely in relation to the direction of travel 7 of the web 1. The opening 9 is defined in the direction of travel 7 by a first and a second long side edge 11 and 13, respectively, with which the web 1 is in sealing contact during its movement. A roller 15 is arranged to pull the web 1 substantially vertically downwards over the opening 9, the web 1 being in close contact with the long side edges 11 and 13. The box 5 is provided at the top with an evacuation opening 17 to which a vacuum pump 19 is connected via a conduit 21. The evacuation opening 17, vacuum pump 19 and conduit 21 together form means for effecting a partial vacuum in the box 5.

The apparatus also comprises members for applying an excess of the coating liquid 3 on the web 1 through the coating opening 9, means for removing the excess of liquid from the web 1 through the coating opening 9, and means for supporting the web 1 during its movement across the coating opening to prevent the web 1 from being drawn too strongly into the coating opening 9. In the embodiment shown in FIGS. 1 to 3 the application members comprise a supply pipe 25 provided with a longitudinal slit 23 or a row of holes, and a blade 27 contacting the web 1 and located below the pipe 25. The slit 23 is directed towards the blade 27 in order to form a pool 3 between the blade 27 and the web 1. In this embodiment the blade 27 also constitutes a wiping blade which is included in the means for removing the excess coating liquid from the web. A supply container 29 for the coating liquid 3 and a conduit 31 from the container 29 to the supply pipe 25 may also be considered as pertaining to the application members. There is preferably a pump 33 in the conduit 31 so that the coating liquid 3 is fed into the supply pipe 25 by means of pump pressure instead of by means of the partial vacuum in the box 5, thus giving greater freedom in designing the plant, but of course it is also feasible to feed the coating liquid by means of the partial vacuum.

The means for removing excess coating liquid from the web 1 includes the blade 27 mentioned. The blade 27 has a lower long side edge in contact with the web 1, this edge constituting the second long side edge 13 of the coating opening. The upper long side edge of the blade 27 is secured to the box 5 by means of two metal sections 35 and 37 together forming a slotted channel having substantially square cross-section, the slit located in a corner near the web 1. The blade 27 is inserted in the slit and held in the desired position by a tube 39 of elastomeric material, such as rubber, which substantially fills the channel cross-section. If desired members, not shown, may be arranged to place the tube 39 under internal over-pressure, so as to fasten the blade 27 more firmly. The metal sections 35 and 37 are clamped in the intended position in relation to each other and the box 5 by means of a number of brackets 41 and screws 43 passing through the brackets 41 into the box 5.

The pool 3 has a spillway 45 formed by the highest edge of the metal sections 35 and 37. Excess coating liquid runs from the pool 3, over the spillway 45 to an outlet 47 in the bottom of the box 5, the outlet being connected by a pipe 49 to the supply container 29. In order to replace coating liquid used for coating the web 1, fresh coating liquid is supplied to the container 29 through a pipe 51 with a valve 53 at such a rate that the level in the container 29 remains constant, and of such composition the tube 25 and the other long side edge 13. The web 1 forms with the supply pipe 25 a long, narrow contact surface 59 extending parallel with the long side edges 13 and 11 and substantially in the same plane as these. The contact surface 59 is considerably narrower in the direction of travel 7 of the web 1 than either of the two sections 55 or 57 of the coating opening 9. It has been found advisable for the first section 55 of the opening 9 to be considerably wider in the direction of travel 7 of the web 1 than the second section 57. The width of the second section 57 is preferably approximately half the width of the first section. It has been found that this ratio between the widths of the two sections 55 and 57 results in a uniform thickness of the coating and also reduces the danger of folds being formed in "slack areas".

In the embodiment shown in FIG. 1, furthermore, the first long side edge 11 consists of a narrow tube 61. The tube 61 is welded or attached in some other suitable manner to one leg of an angle bar 63, the other leg of which is secured to the top of the box 5 by means of screws 65.

Figure 4:
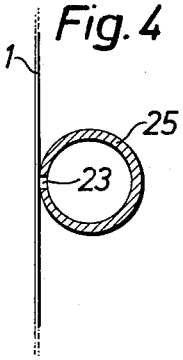
FIGS. 4 and 5 are parts of sections similar to that in FIG. 1 and show alternative arrangements of a supply and application pipe for the coating liquid.
Figure 5:
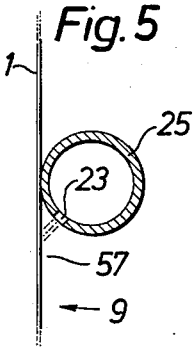

In order to achieve the best possible coating conditions in each individual case it is advisable to arrange members to permit optional adjustment of the support member, i.e. the pipe 25, between the long side edges 11 and 13. Such members are well known per se and by way of example it is shown in FIGS. 2 and 3 that the pipe 25 may be pivotably supported in an inner eccentric bushing 67 at its ends, the bushing 67 being pivotable in a surrounding outer eccentric bushing 69 which in turn is pivotably supported by one end wall 71 of the low-pressure box 5, possibly by way of a reinforcing ring 73. By turning the bushings 67 and 69 the support member or supply pipe 25 can be moved towards or away from either of the long side edges 11 and 13 as well as towards and away from the web 1, the distance being dependent on the eccentricity of the bushings. Furthermore, if desired the supply pipe 25 can be turned so that the slit 23 is directed straight towards the web 1 or so that it is directed obliquely towards the web 1 in the second section 57 of the opening 9, as shown in FIGS. 4 and 5. Once adjusted, the bushings 67 and 69 are suitably locked in the desired position in relation to each other and the end wall 71 in conventional manner so that the setting is not unintentionally altered during operation. The supply pipe 25 may, if desired, be connected to a safety device, not shown, which turns the supply pipe 25, in the event of the web rupture, so that the slit 23 is directed towards the outlet 47.

It is also clear from FIG. 3 that the vacuum box 5 has greater width than the web 1 and that the end wall 71 has a wall section 75 which extends towards the web 1 and which is provided with an elastically deformable sealing strip 77 against which the web 1 is intended to abut. In the direction of travel 7 of the web 1 the wall section 75 is shaped to fit the expected curve in the web 1 caused by its suction into the opening 9.

Irrespective of whether the support member or supply pipe 25 is fixed or adjustable, it is possible to a certain extent to alter the width of the first section 55 and/or the second section 57 of the opening 9 by securing the tube 61 as well as the blade 27 in such a way that they can relatively easily be moved or replaced.

Figure 6:
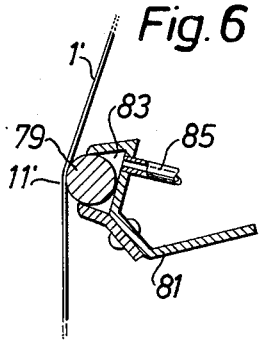
FIG. 6 is a cross-section through an alternative embodiment of the inlet edge portion of the vacuum box.

In order to reduce the friction of the web 1' against the first long side edge 11' it may be advisable to replace the tube 61 with its holder 63 by the arrangement shown in FIG. 6. In this Figure the tube 61 is replaced by a rod 79 having circular cross-section which is rotatably arranged in a holder 81. The holder 81 is provided with a long pocket 83 from which a part of the rod 79 protrudes to provide support for the web 1'. As shown, the pocket 83 may be bigger than required to receive and retain the rod 79 and may be connected to a supply pipe 85 for the supply of fluid for treating the web 1 prior to applying the coating liquid. Obviously, if desired, the same or a similar arrangement may be provided to be carried by the supply pipe 25, or by the vacuum box 5 immediately upstream of the supply pipe 25, to provide a narrow support member with low friction against the web 1. When an absorbant paper web is to be coated with a pigment coating slip, for example, the fluid added to the web by the device illustrated by FIG. 6 may consist of water. Moistening the web with water before coating it with the pigment coating slip ensures that the pigment coating slip does not thicken due to extra liquid loss to the absorbant web.

In certain cases it may be desirable to be able to regulate the sub-pressure at the first opening section 55 and the second opening section 57 irrespective of each other. This can easily be achieved by modifying the apparatus shown in FIG. 1 in the manner shown in FIG. 7. As shown, a wall member 187 parallel with the support member, in this case the supply pipe 125, and at least indirectly in sealing contact therewith, is arranged to divide the low-pressure box 105 in the direction of travel of the web 101 into a first and a second chamber 189 and 191, respectively, associated with the first and second sections 155 and 157, respectively, of the coating opening 109. Each chamber is provided with a separate evacuating opening 117A and 117B for connection to individual vacuum pumps, not shown. The apparatus is otherwise identical with that of FIG. 1, and it is therefore unnecessary to describe FIG. 7 in further detail.

Figure 7:
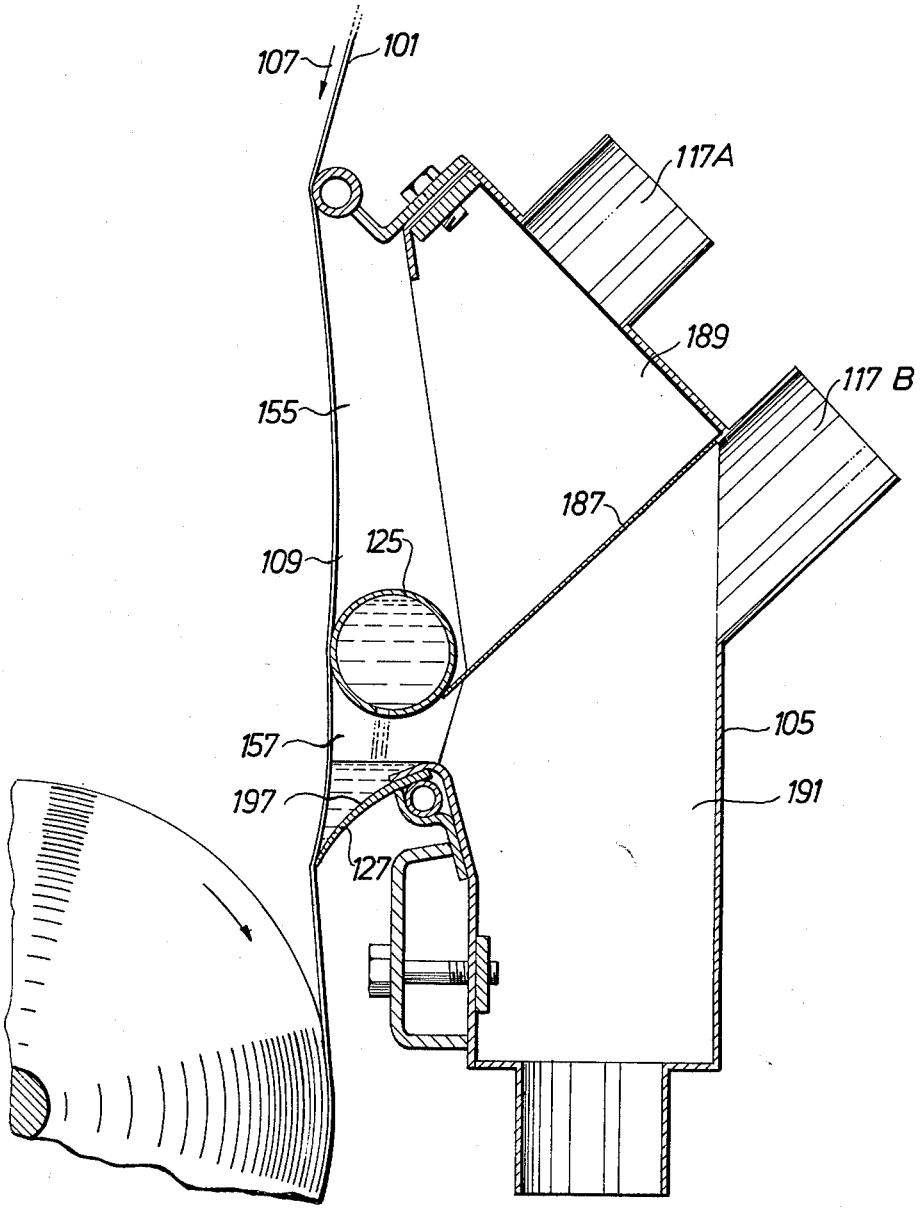
FIG. 7 is a cross-section through a modified vacuum box comprising two separate vacuum chambers.

In the embodiments according to FIGS. 1 and 7 the apparatus is designed for a web moving vertically downwards. However, as is easily understood, the apparatus can easily be modified for use with a web moving vertically upwards or for coating the upper side or lower side of a web moving horizontally. Only minor alterations of the supply and return means for the coating liquid are necessary, and they can easily be achieved by one skilled in the art without any inventive activity.

In all the embodiments described above the blade 27, 127 is sufficiently stiff not to be noticeably deformed by its contact with the web 1, 101. The blade has a convex surface 97, 197 facing the web. It has been found that a blade of this design, which may be of uniform thickness, is particularly useful for achieving the properties aimed at in the finished coating layer, such as good coverage, high surface uniformity and uniform weight per unit area of the layer. The angle between the blade and the web is affected by the partial vacuum in the box and by the width of the second opening section in the direction of travel of the web. The partial vacuum and said width also affect the contact pressure of the web against the blade and the web tension. The web tension is also affected by the width of the first opening section and the friction of the web against the support member.

An important advantage offered by the apparatus according to the invention is that a gently yielding moving web will be pressed with an even pressure against the relatively stiff blade wiping off the excess coating liquid. In a conventional blade coating apparatus the web is pressed between the blade and a supporting surface. The quantity of coating liquid applied to the web is thus less dependent on the variations in thickness of the web itself, neither will foreign particles on the upper side of the web, or even between the web and the blade, noticeably affect the coating. Furthermore, the risk of such particles becoming caught in front of the blade is substantially eliminated, since they will generally be surrounded by the web and accompany it.

Another important advantage is that the coating quantity can be regulated extremely accurately within a relatively wide interval and that this can be achieved by such a simple measure as regulating the partial vacuum. Without the use of a support surface the apparatus which of course must be adjusted to the properties of the web, primarily its stiffness, provides constant stiffening and pressure of a relatively pliable web against a blade coated with coating slip or the like. A high contact pressure between the web and the blade can first of all be achieved by a low pressure in the vacuum box, and also by a wide gap in the vacuum box. However, a low pressure and a wide gap increases the bending forces exerted on the web, but also gives greater tensile stress in the web and thus a desired stiffening of the web. The greater tensile stress in the web may also be utilized to increase the contact pressure of the web against the blade. A stiff web usually provides the best results, but even a soft pliable web can be coated with good results since the apparatus according to the invention, thanks to the support member, is designed so that the tensile stress and the stiffening of the web can be increased more than the contact pressure. The second opening section located closest to the blade is therefore preferably made only wide enough for the desired contact pressure to be obtained.

The tensile force required for the tensile stress is effected by the roller 15. It is well known that such tensile force may also cause considerable difficulties if there are "slack areas" in the web. The tensile stresses will be concentrated in the sections between such "slack areas", easily resulting in the web being skew or folds appearing. However, it has been found surprisingly with the apparatus according to the invention that this negative effect can be almost entirely eliminated by an increased width of the first opening section, even with relatively very uneven webs. This is evidently to do with the fact that a wider gap and a lower pressure give a more uniform distribution of the tensile stresses in the web. At the same time, however, care must be taken that the tensile stresses in the slack, unstretched parts do not become so great that these parts become even more extended. If there is a risk of this, the web must be supported by additional support members.

EXAMPLE 1:

A multi-layered cardboard, having a weight per unit area of 260 g/m$^2$, and a surface roughness of 1670 Bendtsen, was coated with two slightly different pigment coating slips in an apparatus according to FIG. 1 at a web speed of 50 m/min and a gap width of 150 mm upstream and 75 mm downstream the support member.

| | 1. | 2. |
|---|---|---|
| Pigment: Chalk | 85 parts by weight | 100 parts by weight |
| Titanium dioxide | 15 parts by weight | — |
| Binder: Latex Dox 620 | 13 parts by weight | 13 parts by weight |
| Additives: Calgon (sodium hexameta phosphate) | 0.3 parts by weight | 0.3 parts by weight |
| NaOH | 0.2 parts by weight | 0.2 parts by weight |
| Solids content: | 72% | 68% |
| Viscosity: | 2700 cP | 2000 cP |
| pH: | 8.5 | 8.0 |
| sub-pressure mm water | 400 600 800 | 300 600 900 |
| Quantity applied g/m$^2$ | 13.2 16.0 18.0 | 8.2 13.6 17.4 |
| Bendtsen units | 1220 1140 980 | 1600 1100 840 |

With the above conditions the quantity of coating slip applied increases as the pressure drops, because in spite of increased web tension the web is curved in toward the blade, whereupon the blade angle is reduced and the linear pressure at the tip of the blade is reduced. With the web speed, gap width and sealing end pieces used, it has been possible to vary the quantity applied within the stated interval. However, by altering the conditions it is possible to work with greater coating quantities if desired.

The coating slip may be applied either so that in the first place depressions in the web are filled up, resulting in better surface uniformity (reduced Bendtsen number) or so that depressions and raised parts of the surface receive a covering of approximately the same thickness (as with spray painting, for instance), i.e. a good covering is obtained. This can be relatively easily evaluated by inspection, but unfortunately the result is difficult to translate into figures. With respect to the covering, therefore, it is merely noted that this has been good in all the experiments. Good covering has even been obtained over particles of bark or shives sometimes protruding from a paper web.

A coating which gives both low surface roughness and good covering obviously requires a minimum quantity of coating liquid, and this minimum quantity increases with increased surface roughness of the uncoated web. As stated, the experiments indicate that the new apparatus enables good covering to be achieved even if the quantity of coating slip applied is very small and the coating slip has low viscosity. Lower viscosity at the same time results in lower surface roughness. On the other hand, it is quite possible to use coating slips with high viscosity and thus high solids content, which makes the drying process simpler and less expensive.

EXAMPLE 2

Unbleached sack paper, having a weight per unit area of 80 g/m$^2$, and a surface roughness of 1200 Bendtsen, was blade coated partly with a solid supporting surface in accordance with conventional techniques and partly with the apparatus in accordance with FIG. 1. The coating slip No. 2 as described in Example 1 was used.

| | Conventional | Invention |
|---|---|---|
| Machine speed m/min | 200 | 100 |
| Sub-pressure mm water | — | 200 |
| Quantity applied g/m$^2$ | 32 | 15 |
| Bendtsen units | 175 | 330 |

The experiment was performed using quantities of coating slip applied giving equivalent coverage. The use of the apparatus according to the invention enabled the same coverage to be obtained with a much smaller quantity of coating slip. The Bendtsen number was admittedly higher, but the difference is obviously slight in relation to the difference in the quantity applied. The difference in machine speed specified is, however, not technically necessary.

The invention is not limited to what has been described above but can be varied in many ways within the scope of the following claims. For instance, it may be pointed out that several coating liquids, suitably with separate circulation systems, may be applied in one and the same varuum box. For instance, colour may be added before a covering layer to prevent the cover from coming into contact with the surroundings later on. Furthermore, the excess coating liquid removed may of course be filtered, or cleaned in some other way, before being recirculated.

What is claimed is:

1. Apparatus for applying a coating liquid to a moving web, comprising;

a box having an elongated opening in one wall thereof;

means for continuously conveying a web over said opening;

means for creating a sub-atmospheric pressure in said box to press the web against at least two opposed edges of the opening;

a support member for supporting the web, said member being disposed intermediate said opposed edges and dividing said elongated opening into an upstream opening and a downstream opening;

means for applying an excess of coating liquid to the web while the web travels across the downstream opening; and means for removing the excess liquid from the web and defining the downstream one of said two opposed edges, the width of the upstream opening, measured in the direction of travel of the web, being considerably greater than that of the downstream opening, so as to create a tension in the web traveling over said upstream opening, to thereby eliminate unstretched areas in the web before the coating liquid is applied to the web.

2. Apparatus according to claim 1, characterised in that the width of the downstream opening is approximately half the width of the upstream opening.

3. Apparatus according to claims 1 or 2, characterised in that members are provided to permit adjustment of the support member between said opposed edges.

4. Apparatus according to claim 1, characterised in that the support member consists of a rotatable rod with circular cross-section.

5. Apparatus according to claim 1, characterised in that said application means includes a supply pipe provided with longitudinal slits or rows of holes for the coating liquid, said supply pipe also constituting said support member.

6. Apparatus according to claim 5, characterised in that the supply pipe is pivotable about its longitudinal axis.

7. Apparatus according to claim 5, characterised in that the slits or rows of holes are directed obliquely against the web in the downstream opening.

8. Apparatus according to claim 1, characterised in that the application means includes a supply pipe provided with longitudinal slits or rows of holes arranged to direct the coating liquid straight against the web.

9. Apparatus according to claim 1, characterized in that the means for removing excess coating liquid from the web comprises a wiping blade in contact with the web.

10. Apparatus according to claim 9, characterised in that the blade is sufficiently stiff not to be noticeably deformed by the contact pressure of the web against the blade.

11. Apparatus according to claim 9 or 10, characterised in that the blade has a convex outer section facing the web.

12. Apparatus according to claim 9, wherein the web travels in a downward direction and a pool of coating liquid is formed between the web and the wiper blade, and wherein said application means comprises a supply pipe provided with longitudinal openings for supplying the coating liquid to said pool, said supply pipe also forming said support member.

13. Apparatus according to claim 1, characterised in that a wall member is arranged to divide the vacuum box into a first and a second chamber associated with the upstream and downstream portions, respectively, of the coating opening, and that the means for creating a subatmospheric pressure in the box is arranged to permit the partial vacuums in said first and second chambers to be regulated independently of each other.

14. Apparatus according to claim 1 wherein the width of said upstream opening is at least twice the width of said downstream opening.

15. Apparatus according to claim 1, wherein the area of contact between the web and said support member has a width which is less than the width of either of said upstream opening and said downstream opening.

* * * * *